United States Patent [19]

Mitchell

[11] 4,124,338

[45] Nov. 7, 1978

[54] HOT BRIQUETTE PRESS

[75] Inventor: Robert D. Mitchell, Solon, Ohio

[73] Assignee: Combustion Engineering, Inc., Windsor, Conn.

[21] Appl. No.: 839,150

[22] Filed: Oct. 3, 1977

[51] Int. Cl.[2] ..... B30B 11/02

[52] U.S. Cl. ..... 425/78; 425/352; 425/423

[58] Field of Search ..... 425/78, 256, 352, 354, 425/355, 423, 590, 591, 585; 72/273

[56] References Cited

U.S. PATENT DOCUMENTS

| | | | |
|---|---|---|---|
| 2,252,697 | 8/1941 | Brassert | 72/273 X |
| 2,404,554 | 7/1946 | Oshbaugh | 425/354 X |
| 3,266,096 | 8/1966 | Thomas et al. | 425/256 X |
| 3,736,084 | 5/1973 | Mitchell | 425/78 |
| 3,811,813 | 5/1974 | Taccone | 425/352 X |
| 3,923,440 | 12/1975 | Bettonica | 425/352 X |

*Primary Examiner*—J. Howard Flint, Jr.
*Attorney, Agent, or Firm*—Wayne H. Lang

[57] ABSTRACT

A hot briquetting press having a stationary anvil and a reciprocating ram movable through a chip-box that includes a water-cooled jacket to remove excessive heat therefrom. The cooling jacket includes an arcuate wall that is spaced from the reciprocating ram a distance that permits a layer of discrete chips to be disposed therein as an insulation barrier intermediate the reciprocating ram and the water-cooled jacket to preclude the cooling of the hot chips adjacent the ram before they are pressed into a briquette.

4 Claims, 4 Drawing Figures

HOT BRIQUETTE PRESS

BACKGROUND OF THE INVENTION

In the operation of a briquetting press of the stationary anvil-movable die type, a briquette is formed by moving the die and an associated chip-box into engagement with the anvil and then moving the ram through the chip-box and into the die to compact the discrete material into a dense block having an overall configuration designated by the die. The die and the ram are then retracted to permit the briquette to fall by gravity from the anvil to a suitable collecting device. Heretofore metallic chips or other discrete materials were processed at an ambient temperature whereby the briquetting press being used was not subjected to excessively high temperatures. It has been disclosed, however, that briquettes formed from metallic scrap materials that have been heated to a suitably high temperature at which all volatile constituents have been vaporized and which already contain a substantial amount of preheat are desirable where further melting is scheduled. Heating the scrap materials may be only a preferred procedure where smoke abatement is concerned, but it is absolutely necessary where induction melting is scheduled as a subsequent operation. With the present invention there is therefore provided a briquetting press of improved design wherein metallic chips or other scrap materials being formed into briquettes are first heated to a high temperature and then they are subjected to a high compacting pressure in a fluid-cooled briquetting press that cools the press without cooling the heated chips.

SUMMARY OF THE INVENTION

In accordance with the invention, therefore, there is provided a briquetting press adapted to receive metallic chips or other scrap materials from a bulk type heater that raises the temperature of the chips to a predetermined high temperature prior to their transfer to the briquetting press. The chips are heated to reduce their yield strength whereby they may more readily be compressed into a uniformly dense briquette, or they may be easily formed in a larger press having increased capacity. Moreover, first heating the metallic chips gets rid of residual oil and water that may affect the compactibility of the chips and provide for subsequent air pollution, while residual heat that remains in the briquettes may comprise an effective form of preheat to be utilized when the briquettes are subsequently introduced into a melting furnace.

The briquetting press comprises essentially a hopper including a reciprocating die through which a reciprocating ram compresses a quantity of discrete metallic chips against a stationary anvil.

The briquetting press is cored to provide passageways for a coolant. One passageway permits the circulation of a cooling fluid through the anvil, while a cooling jacket having an inlet and an outlet is provided subjacent the chip-box to direct a cooling fluid therethrough to prevent the chip-box and associated parts of the press from becoming overheated from continuous contact with the hot chips.

Inasmuch as cooling the chip-box would simultaneously cool the heated chips therein, the obvious advantages originally gained by heating the chips would be lost if the chips were allowed to cool before they were suitably compressed. Therefore it is an object of my invention to provide a cooling jacket for cooling the chip-box without permitting excessive cooling of the chips therein. More particularly it is an object of my invention to provide a trough-like boundary wall lying between the cooling jacket and the chip-box that is spaced therefrom to become a depository for a layer of loose chips whereby said layer of chips will in effect comprise a layer of insulation that separates the hot chips in the chip-box from the fluid coolant circulating through the cooling jacket therefor.

These and other objects of my invention will become more apparent when considered in conjunction with the annexed drawings in which:

DESCRIPTION OF THE PREFERRED EMBODIMENT

Figure 1:
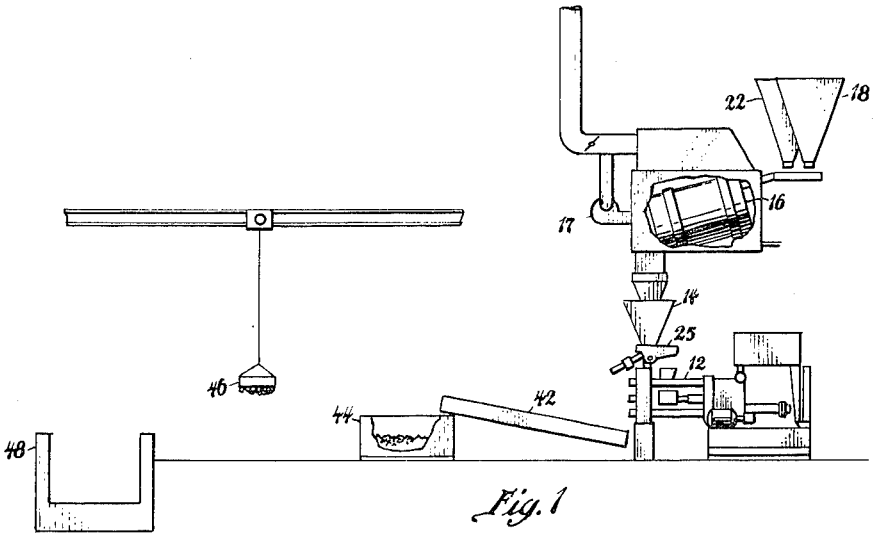
FIG. 1 is a diagrammatic view of a system having a briquetting press that receives hot chips from a bulk type heater and passes them on to a melting furnace.

Referring more particularly to the drawings wherein the numeral 12 designates a briquette forming machine having a hopper 14 that receives a quantity of hot metallic chips from a heating and drying furnace 16. In furnace 16 oil and water contamination are removed from the chips as a vapor that is generated by heating the chips to a predetermined temperature that ranges from 800° F. to 1400° F. The vaporized oil may be directed back through a recirculation fan 17 to the drying furnace to serve as fuel that further heats and dries the chips being supplied to the furnace from the feed hopper 18. A similar hopper 22 in parallel with that at 18 is used to supply alloying agents or other additives to the drying system before the chips are passed to the hopper 14 of the briquette forming machine 12.

Figure 3:
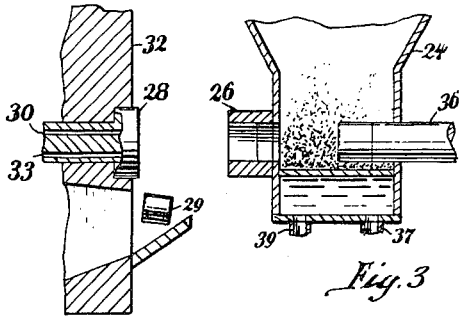
FIG. 3 is a side view of the water-cooled anvil with a retracted ram.
Figure 2:
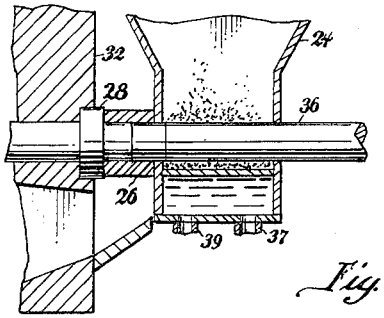
FIG. 2 is a side view of a briquetting press with a ram thereof in an advanced position.
Figure 4:
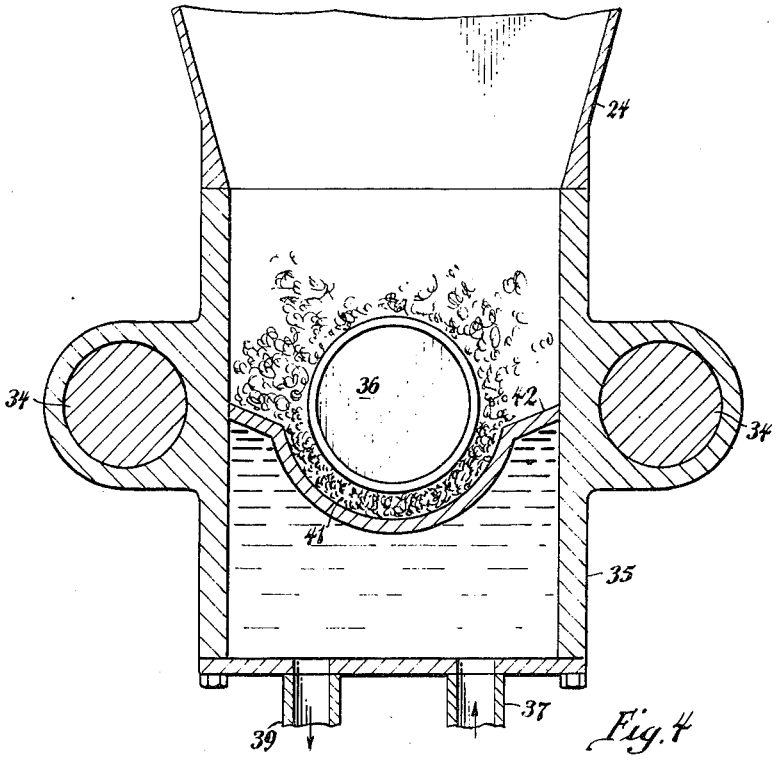
FIG. 4 is a cross-sectional view, enlarged, of an insulating layer of chips lying between a cooling jacket and a hopper containing a quantity of hot chips.

The hot metallic chips are directed through a measuring device 25 and chip-box to a die 26 where the hot chips are compressed against anvil 28 into a dense briquette 29. After the briquette has been formed, the chip-box 24 and the die assembly 26, together with independent ram 36, are withdrawn in the manner shown by FIG. 3 to release the briquette just formed and to receive a new charge of material. After release from die 26, the briquette falls by gravity to a conveyor 42 where it is moved to a storage bin 44 and thence by overhead crane 46 to a melting furnace 48. The hot chips being formed into briquettes have a much lower yield point than do similar chips when cold, therefore when compressed into composite blocks there is much less tendency for each chip to "springback" to a normal position held before it was compressed. Furthermore, since the hot chips are free of all forms of oil and water contamination, they may be compressed into a dense briquette that represents only the volume of the metal.

Although the briquettes formed in the manner above described are at times subject to free-fall onto a hard surface, the uniformly high density with which each briquette is formed precludes to a great extent any spalling and breaking that would negate the various advantages gained by first forming the hot chips into briquettes.

To eliminate overheating of the anvil 28 and the associated parts of the briquette forming machine from a loss of integrity through long and continuous contact with the hot chips, special passageways for a cooling fluid are provided. Accordingly the anvil 28 is cored to provide an inlet for cooling fluid 30 and an outlet 33 to permit the circulation of a coolant therethrough. Similarly the chip-box actuating pistons 34 may be supplied with cooling passages (not shown), while a cooling jacket 35 having an inlet 37 and an outlet 39 permits the circulation of a cooling fluid therethrough to preclude the temperature of the entire chip-box from rising to that of the heated chips.

The cooling jacket 35 is separated from the lower portion of the chip-box by an imperforate wall 42 that is formed with an arcuate configuration that lies spaced from the underside of the ram 36 to provide a concentric space 41 that is continuously filled with a layer of loose chips. The loose chips serve as an insulative barrier between the cooling jacket and the hot chips carried by the chip-box whereby the lower portion of the chip-box may be suitably cooled while the chips themselves are permitted to remain in their heated condition.

The uniformly high density with which each briquette is formed imparts thereto a resistance to spalling and breaking that results in less melting loss and oxidation when the briquettes are introduced into a melting furnace. Furthermore, the briquettes so formed are uniform in size and density so that their use promotes a controlled charge that is instrumental in enhancing subsequent melting operations.

I claim:

1. A briquetting system including a press having in combination a frame means, an anvil with a convex configuration supported by said frame means, a chip-box adapted to carry a quantity of hot metallic chips, a die assembly integral with and horizontally aligned with said chip-box, means for reciprocating the chip-box and die assembly on the frame from an advanced position where the die engages the anvil to a rectracted position where the die is spaced from the anvil, a water-cooling jacket subjacent said chip-box, a reciprocating ram movable through said chip-box and aligned die assembly to compress a quantity of metallic chips against the face of said anvil, and an imperforate wall intermediate the ram and the chip-box forming a clearance space in the chip-box between the reciprocating ram and the water-cooling jacket that is adapted to hold a quantity of loose chips that serve as an insulation barrier separating the cooling jacket from the reciprocating ram.

2. A briquetting press as defined in claim 1 wherein the imperforate wall that lies adjacent the clearance space in the chip-box is arcuately formed to provide a clearance space concentric with the lower portion of the reciprocating ram.

3. A briquetting press as defined in claim 1 wherein the anvil is cored to provide a passageway therethrough for a cooling fluid.

4. A briquetting press as defined in claim 1 including means adapted to heat the loose chips before they are introduced into the chip-box.

* * * * *